US006701851B2

(12) United States Patent
Ibrahim

(10) Patent No.: US 6,701,851 B2
(45) Date of Patent: Mar. 9, 2004

(54) STAND FOR READING MATERIALS AND LAPTOP COMPUTERS

(76) Inventor: Zafar Y. Ibrahim, 7923 Leschi Rd., SW., Lakewood, WA (US) 98259

( * ) Notice: Subject to any disclaimer, the term of this patent is extended or adjusted under 35 U.S.C. 154(b) by 0 days.

(21) Appl. No.: 10/098,773

(22) Filed: Mar. 19, 2002

(65) Prior Publication Data

US 2003/0177957 A1 Sep. 25, 2003

(51) Int. Cl.[7] ..... A47F 5/12
(52) U.S. Cl. ..... 108/6; 108/50.01
(58) Field of Search ..... 108/6, 1, 10, 8, 108/50.01

(56) References Cited

U.S. PATENT DOCUMENTS

| | | | | |
|---|---|---|---|---|
| 356,023 | A | * | 1/1887 | Aston |
| 388,417 | A | * | 8/1888 | Kidder |
| 1,652,774 | A | * | 12/1927 | Fraser et al. |
| 1,770,955 | A | * | 7/1930 | Storm |
| 2,704,235 | A | * | 3/1955 | Bion |
| 3,557,791 | A | * | 1/1971 | Duffy |
| 4,248,161 | A | * | 2/1981 | Adair et al. |
| 4,552,362 | A | * | 11/1985 | Oake |
| 4,681,042 | A | | 7/1987 | Roberts |
| 4,789,048 | A | * | 12/1988 | Cramer et al. |
| 4,947,763 | A | | 8/1990 | Piorek |
| 5,083,558 | A | * | 1/1992 | Thomas et al. |
| 5,348,377 | A | | 9/1994 | Grosch |
| 5,356,203 | A | | 10/1994 | Levasseur |
| 5,577,806 | A | | 11/1996 | Ugalde |
| 5,626,393 | A | | 5/1997 | Levasseur |
| 6,398,326 | B1 | * | 6/2002 | Wang |

FOREIGN PATENT DOCUMENTS

FR 2635659 * 3/1990

* cited by examiner

*Primary Examiner*—Jose V. Chen
(74) *Attorney, Agent, or Firm*—Richard L. Huff

(57) ABSTRACT

A height-adjustable, tiltable stand for a laptop computer or reading material. The stand contains two side legs, each of which contains an upper surface made of a distal section parallel to the bottom and a proximal section which is at an angle to the distal section. The legs contain a centrally located hole near the upper surface. The top contains a lip for maintaining material on the top when the top is tilted. The top contains a plurality of holes for allowing heat generated by a computer to dissipate. Each side edge of the top contains depending supports having centrally located slots. Tightness controllers made up of a knob, a bolt, and a nut pass through the holes in the legs and the depending support to hold the top to the legs and to allow the top to be tilted on the legs.

3 Claims, 5 Drawing Sheets

STAND FOR READING MATERIALS AND LAPTOP COMPUTERS

BACKGROUND OF THE INVENTION

1. Field of the Invention

The present invention relates to platforms for holding reading materials and laptop computers. The platforms are supported about two legs and are tiltable about the tops of the legs. Provision is made for vertical adjustment of the platforms.

2. Description of the Related Art

Platforms with height adjustable and tiltable features are known in the art.

U.S. Pat. No. 4,681,042 discloses a drafting table which requires the use of a pedal, an elongated member and a spring to adjust the position of the drawing surface.

U.S. Pat. No. 4,947,763 discloses a height-adjustable, tiltable table which requires an arcuate guiding path with arcuate rods to provide the desired positioning.

U.S. Pat. No. 5,348,377 discloses a footrest which is height-adjustable and tiltable. Rollers attached to the platform traverse the top surfaces of a generally triangular support to provide the desired angle while adjustment of the distance between the rollers provides for the desired height.

U.S. Pat. Nos. 5,356,203 and 5,626,393 disclose footrests which contain a platform for supporting the feet, each side of which is supported by a triangular frame. Foot pressure on the platform can determine the degree of tilt of the surface.

U.S. Pat. No. 5,577,806 discloses a footrest which contains a platform, two side base portions, and an intermediate member which is coupled to the platform and the base members. Rotation about offset axes provides the desired height and degree of tilt.

SUMMARY OF THE INVENTION

The present invention is directed to a stand for reading material or a laptop computer. More particularly, the stand comprises a flat top section having ventilation holes for allowing air to cool a laptop computer. The flat top section also comprises a raised lip for preventing the laptop computer or the reading material from sliding off when the top is in the tilted position. Each side of the top section has a depending support. Each support contains an elongated hole along the center line. Two mirror-image legs having triangular-shaped top surfaces with off-center apexes support the top section. These legs also contain holes along the center line thereof. Knobs attached to threaded bolts which fasten to nuts allow the connection between the supports and the legs to be tight or loose. When tight, the top is secured in an immovable position with respect to the legs. When loose, the top may be freely moved to a different position. Thus, the stand of the present invention contains few parts, is simple to assemble, and provides a stand for either a laptop computer or reading material, which stand is height adjustable and tiltable along the axis provided by the apexes of the triangular-shaped tops of the legs.

DESCRIPTION OF THE PREFERRED EMBODIMENTS

Figure 1:
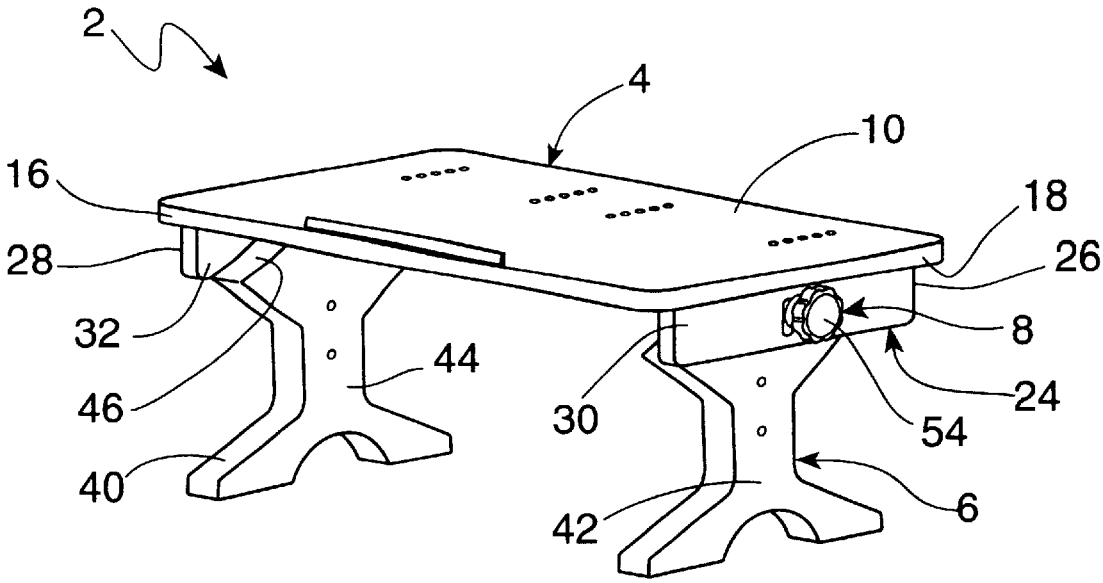
FIG. 1 is an elevational perspective view of the stand of this invention showing the top in a horizontal position.
Figure 2:
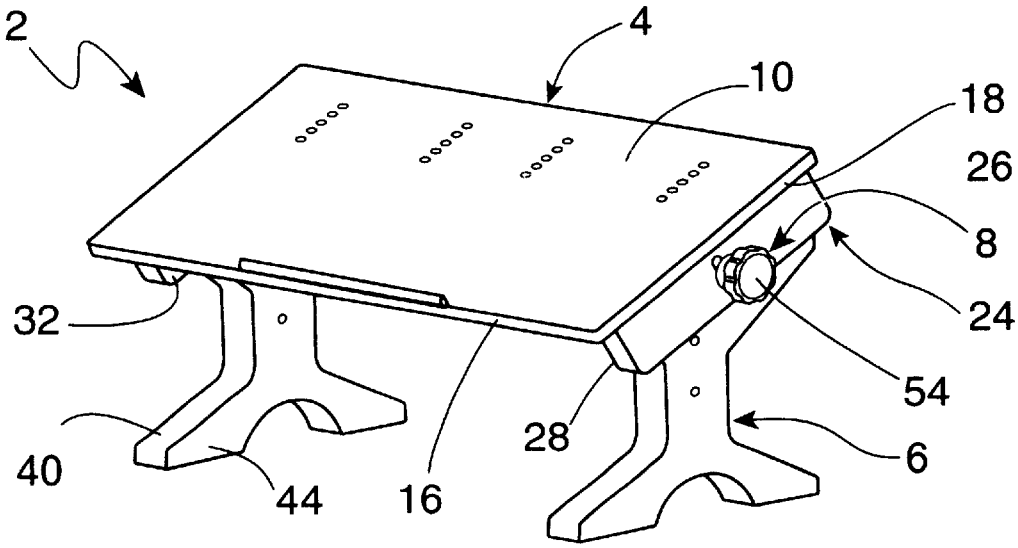
FIG. 2 is an elevational perspective view of the stand of this invention showing the top in a tilted position.
Figure 3:
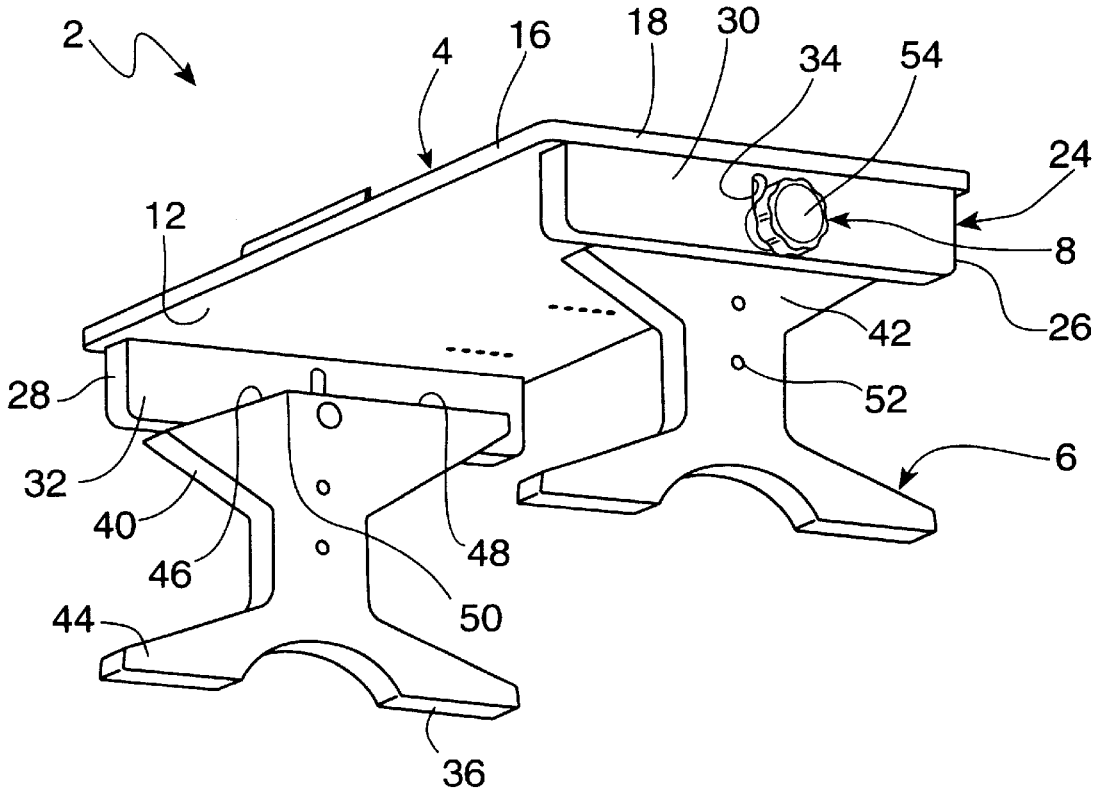
FIG. 3 is an elevational perspective view of the underside of the stand showing the top in a raised, horizontal position.
Figure 4:
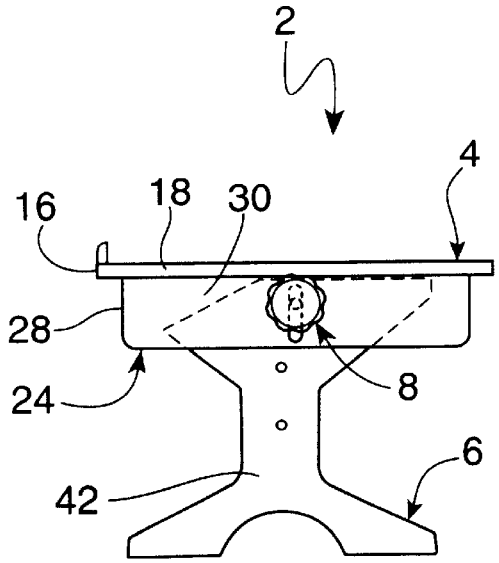
FIG. 4 is an elevational side view of the stand of this invention showing the top in a lowered, horizontal position.
Figure 5:
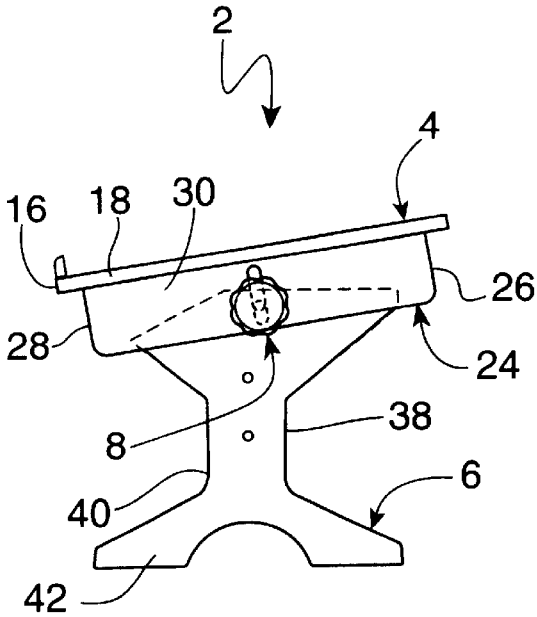
FIG. 5 is an elevational side view of the stand of this invention showing the top in a raised, slightly tilted position.
Figure 6:
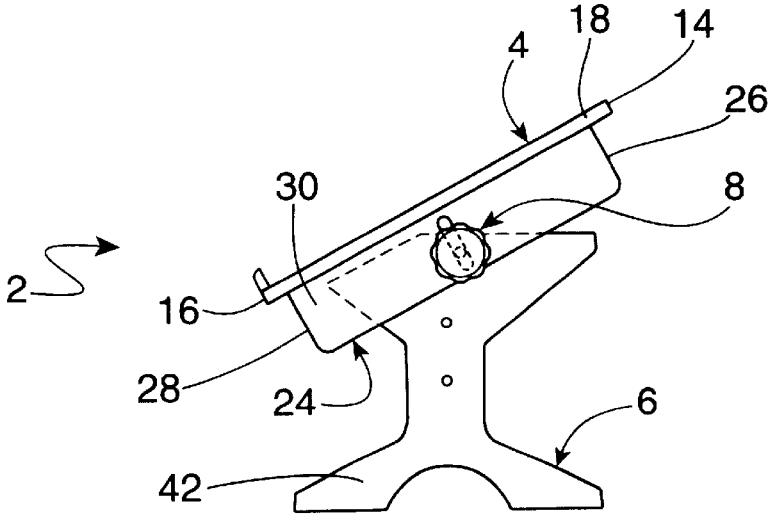
FIG. 6 is an elevational side view of the stand of this invention showing the top in a raised, fully tilted position.
Figure 7:
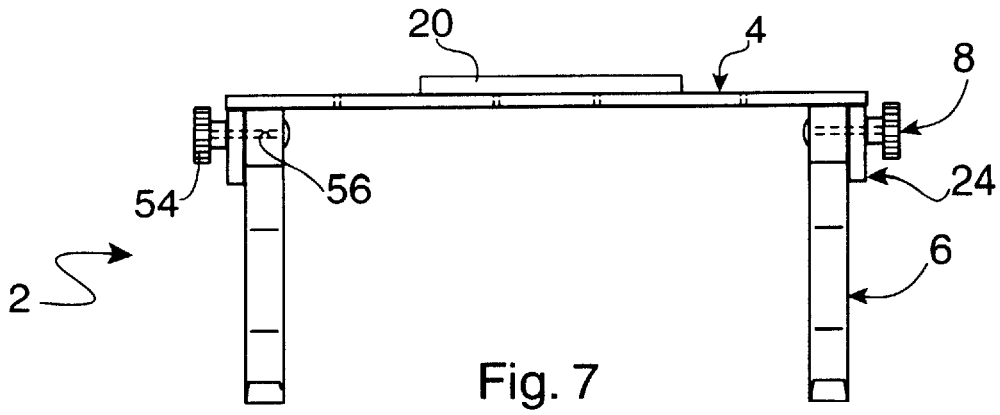
FIG. 7 is an elevational front view of the stand of this invention.
Figure 8:
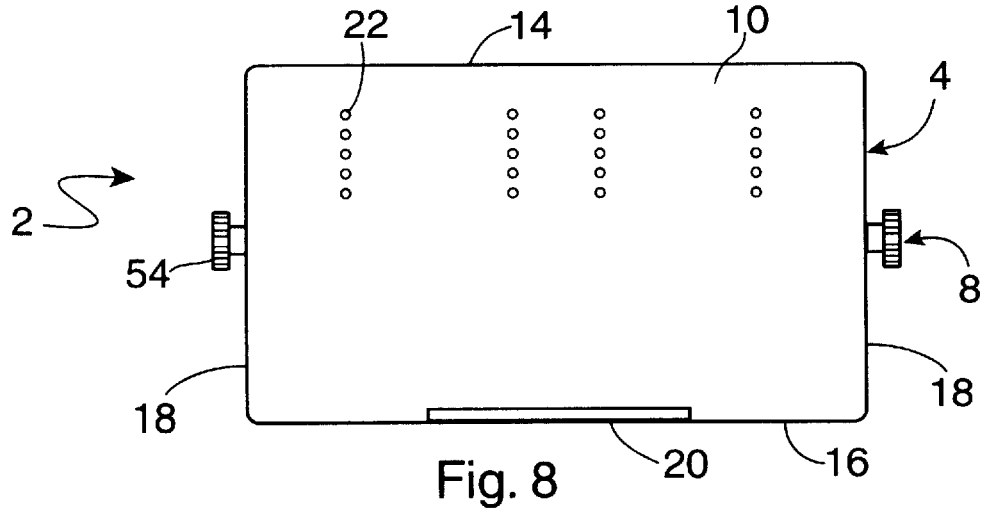
FIG. 8 is a plan view of the top of the stand.
Figure 9:
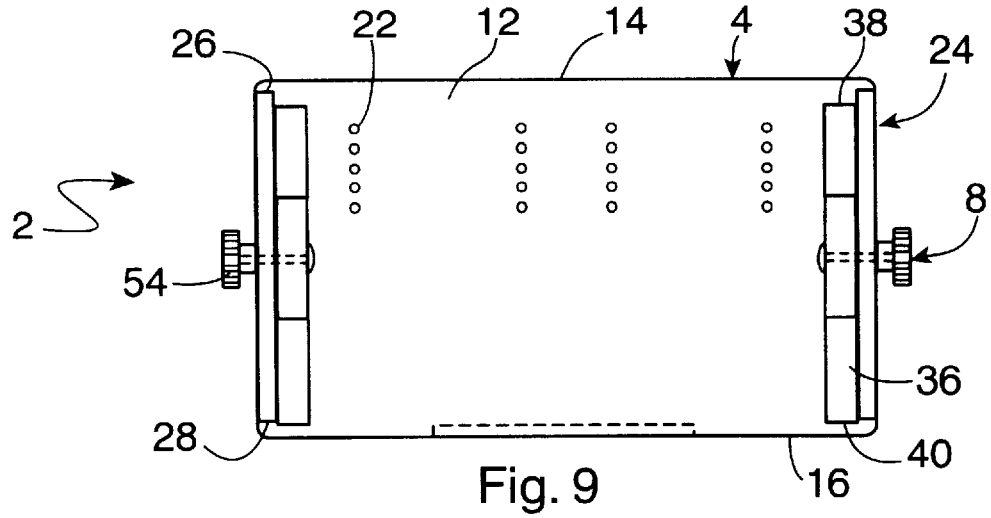
FIG. 9 is a plan view of the bottom of the stand.
Figure 10:
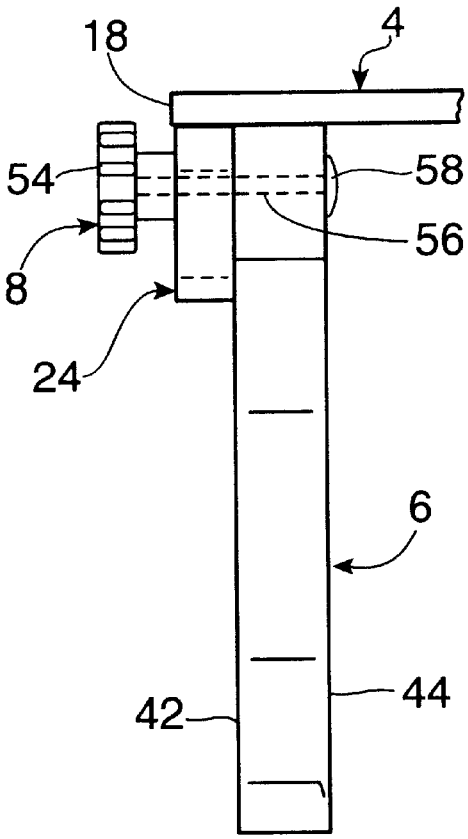
FIG. 10 is an elevational side view, in detail, showing the top in a lowered position.
Figure 11:
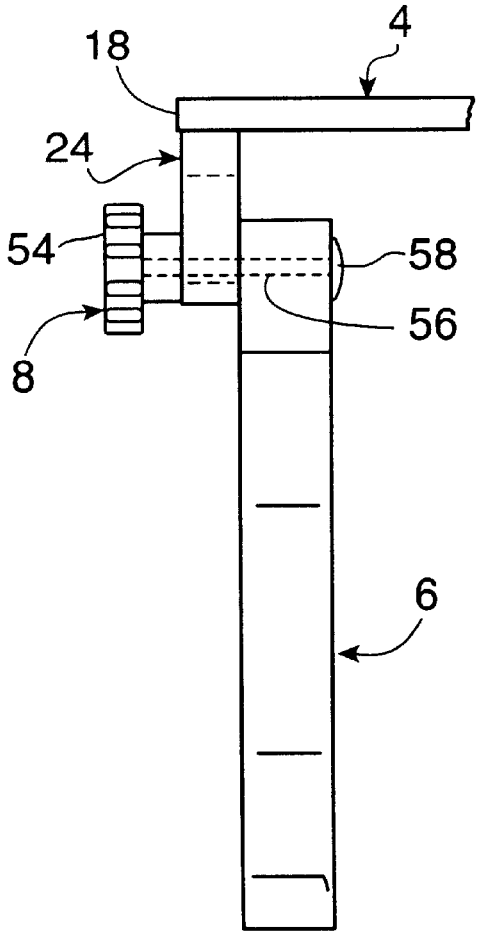
FIG. 11 is an elevational view, in detail, showing the top in a raised position.

The preferred embodiments of the present invention will now be described with reference to the above drawings, wherein like identifying numerals refer to like parts throughout.

The stand 2 of the present invention is simple in design and construction. The stand 2 comprises a flat top section 4, a pair of legs 6, and a pair of tightness controllers 8 which join the legs 6 to the flat top section 4.

The flat top section 4 comprises a top surface 10, a bottom surface 12, a distal surface 14, a proximal surface 16, two side surfaces 18, a lip 20 on the top surface 10 centered between the two side surfaces 18 and located at or near the proximal surface 16. The function of the lip 20 is to prevent the laptop computer or the reading material from sliding off the flat top section 4 when the flat top section 4 is in the tilted position. The flat top section 4 additionally contains a plurality of holes 22 extending from the top surface 10 to the bottom surface 12. The holes 22 provide ventilation for the laptop computer in order to keep the computer from becoming too warm.

There are two depending supports 24 extending from at or near the proximal surface 16 to at or near the distal surface 14 of the flat top section 4. These depending supports 24 have distal ends 26, proximal ends 28, lateral side surfaces 30, and medial side surfaces 32. These depending supports 24 are located medially from the two side surfaces 18 of the flat top section 4 at least a distance equal to the thickness of the legs 6. Each depending support 24 has a slot 34 running through it from the lateral side surface 30 to the medial side surface 32. The slot 34 is placed midway between the proximal surface 16 and the distal surface 14 of the flat top section 10.

The stand 2 comprises a pair of legs 6. Each leg 6 comprises a bottom surface 36, a distal surface 38, a proximal surface 40, a lateral surface 42, a medial surface 44, a proximal top surface 46 and a distal top surface 48. The distal top surface 48 is parallel to the bottom surface 36. The proximal 46 and distal 48 top surfaces meet at an apex 50 which is offset from the center line between the distal surface 38 and proximal surface 46 such that when the flat top section 4 rests upon the distal top surface 48, the flat top section 4 is parallel to the bottom surface 36 and, therefore, parallel to the surface upon which the stand 2 rests. When the flat top section 4 rests upon the proximal top surface 46, the flat top surface 4 is tilted toward the user up to an angle of 45°. Each leg 6 has at least one hole 52 running through it from the lateral surface 42 to the medial surface 44. This hole 52 is located on a line midway between the proximal surface 40 and distal surface 38 of the leg 6.

The legs 6 and depending supports 24 are joined together by tightness controllers 8. A tightness controller 8 comprises a knob 54 having a size and shape as to be readily turned by hand. The knob 54 is fixedly attached to a bolt 56 which has external threads at the end opposite the knob 54. The external threads of the bolt 56 fit into internal threads of a nut 58. When the stand 2 is assembled, the knob 54 is on the lateral side 30 of a depending support 24 and the nut 58 is on the medial side 44 of a leg 6. The bolt 56 passes through the slot 34 in the depending support 24 and the hole 52 in the legs 6. The tightness controllers 8 allow easy tightening and loosening of the fit between a leg 6 and a depending support 24. When tightened, the depending support 24 remains in position. When loosened, the depending support 24 may be raised or lowered relative to the legs 6. Also, when loosened, the depending support 24 may be tilted about the apex 50 formed by the meeting of the distal top surface 48 and the proximal top surface 46 of the leg 6. The flat top surface 4 may be made to rest on the proximal top surface 46 of the legs 6, the distal top surface 48 of the legs 6, any desired location in between, or may be raised above the top surface 46, 48 of the legs 6.

The result is a stand 2 suitable for holding a laptop computer or reading material at a variety of heights and degrees of tilt. The stand 2 is easy to assemble, easy to use, and versatile in its utility.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A stand comprising:

A) a flat top section comprising a top surface, a bottom surface, a distal surface, a proximal surface, two side surfaces, a lip on the top surface centered between the two side surfaces, a plurality of holes extending from the top surface to the bottom surface, and two depending supports located medially from the two side surfaces of the flat top section at least a distance equal to the thickness of the legs, wherein each depending support has a slot running through it from the lateral side surface to the medial side surface, the slot being midway between the proximal surface and the distal surface of the flat top section, further wherein each depending support extends from at or near the proximal surface to at or near the distal surface, which depending supports have straight distal surfaces, straight proximal surfaces, straight lateral side surfaces, straight medial side surfaces, and straight bottom surfaces;

B) a pair of legs, each leg comprising a bottom surface, a distal surface, a proximal surface, a lateral surface, a medial surface, a proximal top surface and a distal top surface, the distal top surface being parallel to the bottom surface and the proximal and distal top surfaces meet at an apex which is offset from a center located midway between the distal surface and proximal surface such that when the flat top section rests upon the distal top surface, the flat top section is parallel to the bottom surface and when the flat top section rests upon the proximal top surface, the fiat top surface is tilted, and C) a pair of tightness controllers which join the legs to the depending supports.

2. The stand of claim 1, wherein:

each leg has a hole running through it from the lateral surface to the medial surface, which hole is located on a line midway between the proximal surface and distal surface of the leg.

3. The stand of claim 2, wherein:

the legs and depending supports are joined together by tightness controllers, each tightness controller comprising a knob having a size and shape as to be readily turned by hand, which knob is fixedly attached to a bolt which has external treads at the end opposite the knob, the external threads of the bolt fit into internal threads of a nut such that when the stand is assembled, each knob is on the lateral side of a depending support and each nut is on the medial side of a leg, the bolt passes through the slot in the depending support and the hole in the legs.

* * * * *